US007233302B2

(12) United States Patent
Ishizuka

(10) Patent No.: US 7,233,302 B2
(45) Date of Patent: Jun. 19, 2007

(54) DISPLAY APPARATUS WITH ACTIVE MATRIX TYPE DISPLAY PANEL

(75) Inventor: Shinichi Ishizuka, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 118 days.

(21) Appl. No.: 10/304,854

(22) Filed: Nov. 27, 2002

(65) Prior Publication Data

US 2003/0128201 A1 Jul. 10, 2003

(30) Foreign Application Priority Data

Nov. 27, 2001 (JP) ..... 2001-360715

(51) Int. Cl.

| | |
|---|---|
| ***G09G 3/30*** | (2006.01) |
| ***G09G 3/32*** | (2006.01) |
| ***G09G 3/34*** | (2006.01) |
| ***G09G 3/36*** | (2006.01) |
| ***G09G 5/00*** | (2006.01) |
| ***G09G 5/10*** | (2006.01) |

(52) U.S. Cl. ..... 345/77; 345/82; 345/84; 345/91; 345/92; 345/98; 345/100; 345/204; 345/690

(58) Field of Classification Search ..... 345/44–46, 345/82, 212, 77

See application file for complete search history.

(56) References Cited

U.S. PATENT DOCUMENTS 5,719,589 A * 2/1998 Norman et al. ..... 345/82
5,903,246 A * 5/1999 Dingwall ..... 345/82
6,369,786 B1 * 4/2002 Suzuki ..... 345/77
6,633,135 B2 * 10/2003 Nara et al. ..... 315/169.3
6,839,054 B2 * 1/2005 Abe et al. ..... 345/204
6,859,193 B1 * 2/2005 Yumoto ..... 345/82

FOREIGN PATENT DOCUMENTS

| | | |
|---|---|---|
| EP | 0 923 067 | 6/1999 |
| EP | 923067 A1 * | 6/1999 |
| EP | 1 158 483 | 11/2001 |
| EP | 1 227 467 | 7/2002 |

* cited by examiner

*Primary Examiner*—Sumati Lefkowitz
*Assistant Examiner*—Alexander S. Beck
(74) *Attorney, Agent, or Firm*—Drinker Biddle & Reath LLP

(57) ABSTRACT

A display apparatus which can display an image at a proper luminance corresponding to a video signal irrespective of a temperature-related change or a change with the passage of time. The display apparatus has: a current source for generating a reference current; and a reference transistor having an input terminal for a power voltage, an output terminal to which the current source is connected, and a control terminal connected to the output terminal and having almost the same electrical characteristics as those of a driving transistor for supplying a drive current to a light emitting device serving as a pixel. The driving transistor is driven by a voltage (reference control voltage) on the control terminal of the reference transistor. The loss of electric power can be suppressed by the driving method of this apparatus.

5 Claims, 7 Drawing Sheets

DISPLAY APPARATUS WITH ACTIVE MATRIX TYPE DISPLAY PANEL

BACKGROUND OF THE INVENTION

1. Field of the Invention

The invention relates to a display apparatus having an active matrix driving type display panel.

2. Description of Related Art

Recently, an electroluminescence display apparatus (hereinafter, referred to as an EL display apparatus) is drawing attention, in which a display panel using an organic electroluminescence device (hereinafter, referred to as an EL device) is mounted as a light emitting device including pixels. As the driving scheme for the display panel by the EL display apparatus, an active driving type system is known.

FIG. 1 is a diagram schematically showing the construction of an active driving type EL display apparatus.

As shown in FIG. 1, the EL display apparatus is constituted by a display panel 10 and a driving apparatus 100 for driving the display panel 10 with a video signal.

The following elements are formed on the display panel 10: a common ground electrode 16; a common power electrode 17; scanning lines (scanning electrodes) $A_1$ to $A_n$ serving as n horizontal scanning lines of one screen; and m data lines (data electrodes) $D_1$ to $D_m$ arranged to cross the scanning lines, respectively. Active driving type EL units $E_{1,1}$ to $E_{n,m}$ functioning as pixels are formed in the crossing portions of the scanning lines $A_1$ to $A_n$ and the data lines $D_1$ to $D_m$, respectively. A power voltage $V_A$ to drive the EL units E is applied to the common power electrode 17. The common ground electrode 16 is connected to the ground.

FIG. 2 is a diagram showing an example of the internal construction of one EL unit E formed in the crossing portion of one scanning line A and one data line D.

In FIG. 2, the scanning line A is connected to the gate of an FET (Field Effect Transistor) 11 for selecting the scanning line and the data line D is connected to the drain of the FET 11. The gate of an FET 12 for light emission driving is connected to the source of the FET 11. The power voltage $V_A$ is applied to the source of the FET 12 via the common power electrode 17. A capacitor 13 is connected between the gate and the source of the FET 12. Further, an anode terminal of an EL device 15 is connected to a drain of the FET 12. A cathode terminal of the EL device 15 is connected to the ground via the common ground electrode 16.

The driving apparatus 100 sequentially applies scanning pulses to the scanning lines $A_1$ to $A_n$ of the display panel 10 in an alternative way. The driving apparatus 100 further generates pixel data voltages $DP_1$ to $DP_m$ corresponding to the horizontal scanning lines based on the incoming video signal and applies those voltages to the data lines $D_1$ to $D_m$ in synchronism with the timing of the application of the scanning pulses, respectively. In this process, each EL unit connected to the scanning line A to which the scanning pulse has been applied becomes a writing target of the pixel data. The FET 11 in the EL unit E serving as a writing target of the pixel data turns on in response to the scanning pulse and applies the pixel data voltage DP supplied via the data line D to the gate of the FET 12 and to the capacitor 13, respectively. When the pixel data voltage DP is low, the FET 12 supplies a predetermined light emission drive current Id which is generated based on the voltage $V_A$ to the EL device 15. The EL device 15 emits light at a predetermined luminance in accordance with the light emission drive current Id.

When the gate-source voltage/output current characteristic of the FET 11 is shifted due to a temperature-related change, a change with the passage of time, or the like, even with a fixed gate source voltage $V_{Gs}$(=the power voltage $V_A$−a gate voltage G) a fluctuation of the output current, that is, the light emission drive current Id occurs. This occurrence results in the fluctuation of the luminance of the EL device 15. The power voltage $V_A$ has previously been set to a lightly high voltage in consideration of the increased amount of a forward voltage due to the temperature-related change, change with the passage of time, or the like in the EL device 15. Therefor, the loss of electric power increases at the initial stage or at a standard state.

OBJECTS AND SUMMARY OF THE INVENTION

The invention has been made in view of the above problem and it is an object of the invention to provide a display apparatus which can display an image at a proper luminance corresponding to a video signal irrespective of a temperature-related change or a change with the passage of time of the gate-source voltage/output current.

Another object of the invention is to provide a display apparatus which is designed to reduce the loss of electric power.

According to the invention, there is provided a display apparatus having a display panel in which light emitting units are arranged in a matrix shape, each of the units being constituted by a driving transistor for generating a drive current in accordance with a voltage applied to its control terminal and a light emitting device for emitting light in accordance with the drive current, comprising: a reference control voltage generating circuit which includes a current source for generating a reference current and a reference transistor having an input terminal for a power voltage, an output terminal to which the current source is connected, and a control terminal connected to the output terminal and having same electrical characteristics as those of the driving transistor and which generates a voltage on the control terminal of the reference transistor as a reference control voltage; and a data driver for supplying one of the power voltage and the reference control voltage to the control terminal of the driving transistor in accordance with pixel data of each pixel based on an input video signal.

DETAILED DESCRIPTION OF THE PREFERRED EMBODIMENTS

An embodiment of the invention will be described in detail with reference to the accompanying drawings.

Figure 3:
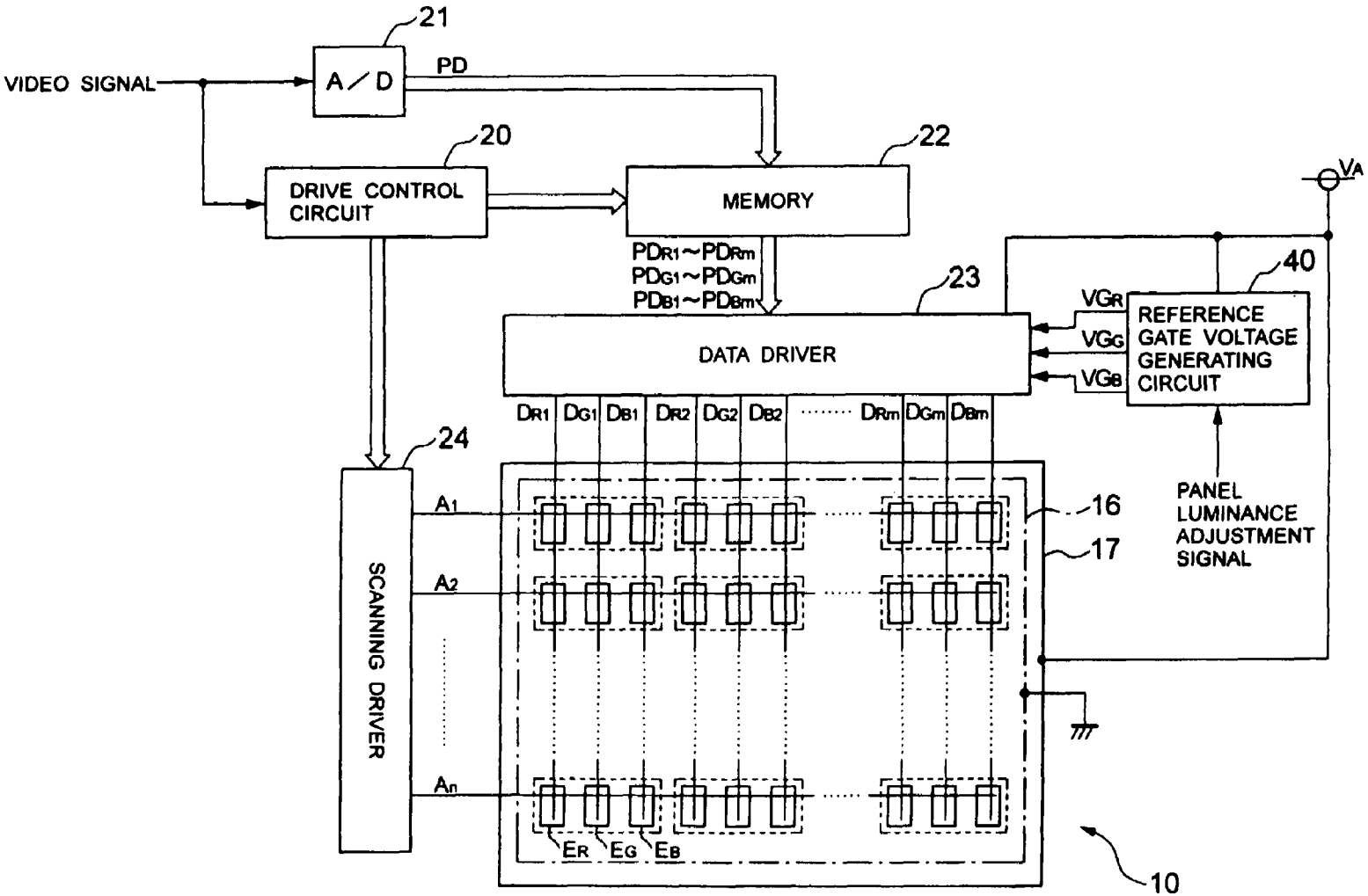
FIG. 3 is a diagram showing the construction of an EL display apparatus of an active matrix driving type according to the invention.

FIG. 3 is a diagram showing the construction of an active matrix driving type EL display apparatus according to the invention.

In FIG. 3, the display panel 10 as an electroluminescence display panel has a common power electrode 17 to which a power voltage $V_A$ from a power source circuit (not shown) is applied and a common ground electrode 16, both are formed on the display 10. Scanning lines $A_1$ to $A_n$ serving as n horizontal scanning lines of one screen, m red drive data lines $D_{R1}$ to $D_{Rm}$, m green drive data lines $D_{G1}$ to $D_{Gm}$, and m blue drive data lines $D_{B1}$ to $D_{Bm}$ which are arranged so as to cross the scanning lines are formed on the display panel 10, respectively. EL units $E_R$ for performing red light emission are formed in the crossing portions of the scanning lines $A_1$ to $A_n$ and the red drive data lines $D_{R1}$ to $D_{Rm}$, respectively. EL units $E_G$ for performing green light emission are formed in the crossing portions of the scanning lines $A_1$ to $A_n$ and the green drive data lines $D_{G1}$ to $D_{Gm}$, respectively. Further, EL units $E_B$ for performing blue light emission are formed in the crossing portions of the scanning lines $A_1$ to $A_n$ and the blue drive data lines $D_{B1}$ to $D_{Bm}$, respectively.

Figure 1:
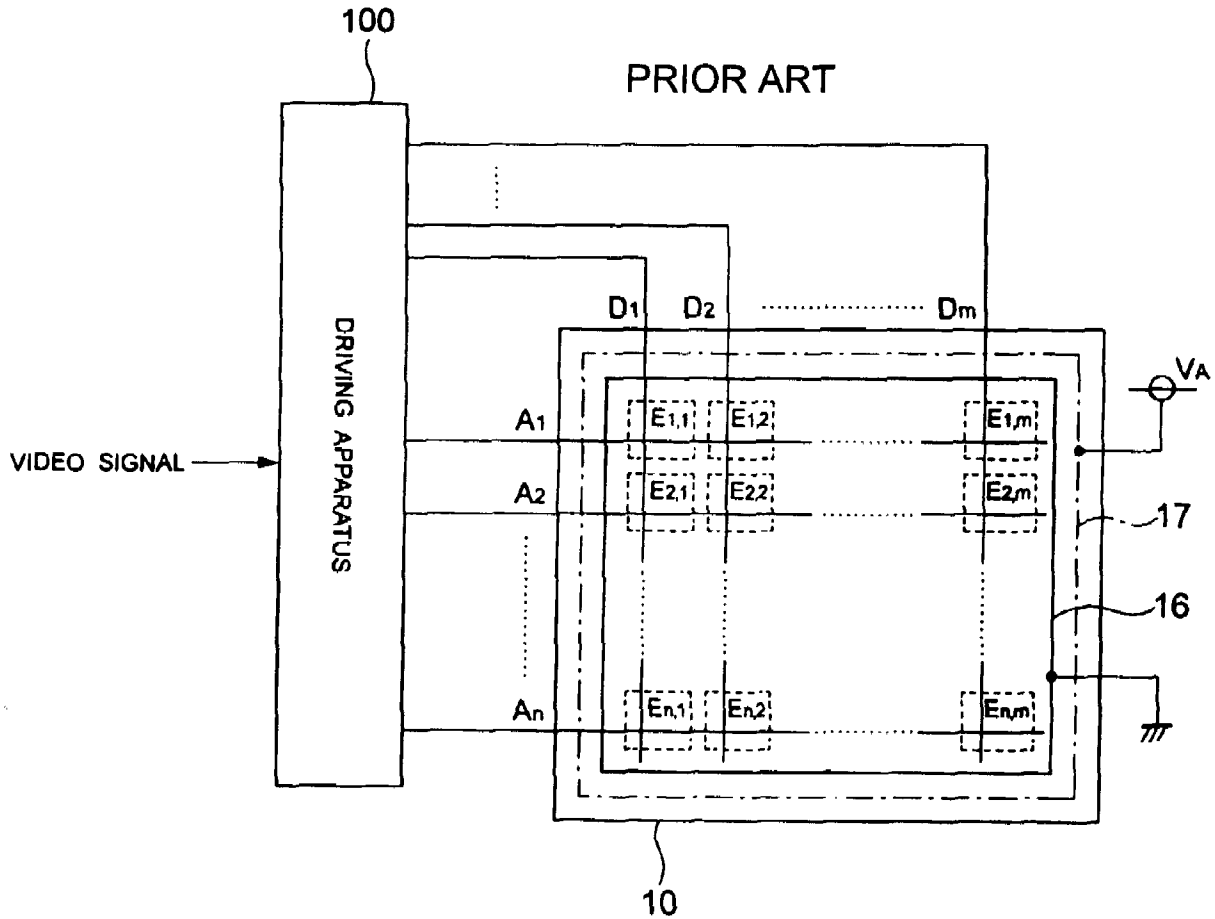
FIG. 1 PRIOR ART
FIG. 1 is a diagram schematically showing the construction of an active matrix driving type EL display apparatus.
Figure 2:
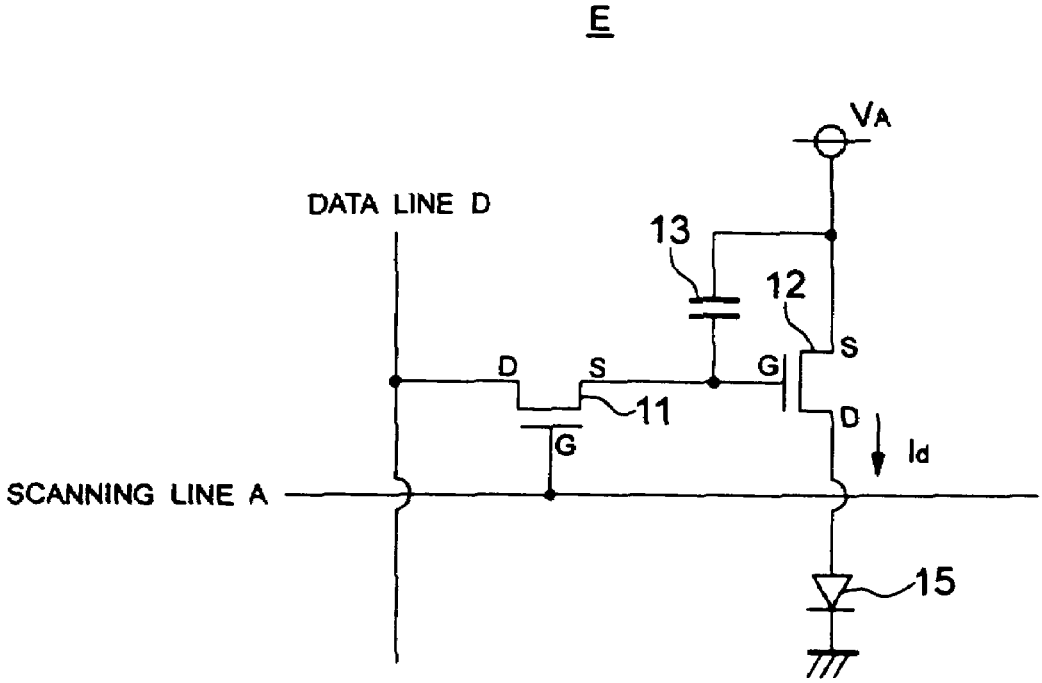
FIG. 2 is a diagram showing an example of the internal construction of an EL unit E serving as each pixel.

Each of the EL units $E_R$, $E_G$, and $E_B$ has an internal construction as shown in FIG. 2. An EL device 15 provided for the EL unit $E_R$ performs the red light emission, an EL device 15 provided for the EL unit $E_G$ performs the green light emission, and an EL device 15 provided for the EL unit $E_B$ performs the blue light emission, respectively.

An A/D converter 21 converts an incoming video signal into pixel data $PD_R$, $PD_G$, and $PD_B$ corresponding to each pixel and supplies them to a memory 22. The pixel data $PD_R$ is pixel data indicative of a red component in the supplied video signal. The pixel data $PD_G$ is pixel data indicative of a green component in the supplied video signal. The pixel data $PD_B$ is pixel data indicative of a blue component in the supplied video signal.

A drive control circuit 20 generates a timing signal indicative of the apply timing of the scanning pulses to be sequentially applied to the scanning lines $A_1$ to $A_n$ in accordance with the supplied video signal and supplies it to a scanning driver 24. In accordance with the timing signal, the scanning driver 24 sequentially applies scanning pulses SP to the scanning lines $A_1$ to $A_n$ of the display panel 10, respectively.

The drive control circuit 20 generates a write signal for sequentially writing the pixel data $PD_R$, $PD_G$, and $PD_B$ to the memory 22 and supplies the write signal to the memory 22. The drive control circuit 20 further generates a read signal for reading out the pixel data $PD_R$, $PD_G$, and $PD_B$ written in the memory 22 line by line and supplies the read signal to the memory 22.

The memory 22 sequentially writes the pixel data $PD_R$, $PD_G$, and $PD_B$ in response to the write signal supplied from the drive control circuit 20. After the completion of the writing operation of one picture plane, the memory 22 reads out the pixel data $PD_R$, $PD_G$, and $PD_B$ line by line and simultaneously supplies transmits the pixel data $PD_R$, $PD_G$, and $PD_B$ as pixel data $PD_{R1}$ to $PD_{Rm}$, $PD_{G1}$ to $PD_{Gm}$, and $PD_{B1}$ to $PD_{Bm}$ to a data driver 23.

The data driver 23 generates pixel data voltage $DP_{R1}$ to $DP_{Rm}$ having voltages corresponding to logic levels of the pixel data $PD_{R1}$ to $PD_{Rm}$ and applies the pixel data voltages to red drive data lines $D_{R1}$ to $P_{Rm}$ of the display panel 10, respectively. The data driver 23 also generates pixel data voltages $DP_{G1}$ to $DP_{Gm}$ having voltages corresponding to logic levels of pixel data $DP_{G1}$ to $DP_{Gm}$ and applies the pixel data voltages to green drive data lines $D_{G1}$ to $D_{Gm}$ of the display panel 10, respectively. The data driver 23 further generates pixel data voltages $DP_{B1}$ to $DP_{Bm}$ having voltages corresponding to logic levels of the pixel data $PD_{B1}$ to $PD_B$m and applies the pixel data voltages to blue drive data lines $PD_{B1}$ to $PD_B$m of the display panel 10, respectively.

The EL unit E connected to the scanning line A to which the scanning pulse SP has been applied as mentioned above becomes a target and the pixel data voltage DP supplied via the data line D of each color is retrieved. That is, in this process, the FET 11 in the EL unit E turns on in response to the scanning pulse SP and applies the pixel data voltage DP supplied via the data line D of each color to the gate of the FET 12 and the capacitor 13, respectively. When the pixel data voltage DP has a predetermined voltage value, the FET 12 supplies the light emission drive current Id based on the power voltage $V_A$ supplied from the power source circuit (not shown) to the EL device 15. In this case, the EL device 15 emits light in accordance with the light emission drive current Id. That is, the EL device 15 in the EL unit $E_R$ emits the red light, the EL device 15 in the EL unit $E_G$ emits the green light, and the EL device 15 in the EL unit $E_B$ emits the blue light, respectively.

The data driver 23 generates the pixel data voltages $DP_R$, $DP_G$, and $DP_B$ on the basis of the power voltage $V_A$ and reference gate voltages $VG_R$, $VG_G$, and $VG_B$ supplied from a reference gate voltage generating circuit 40, respectively.

Figure 4:
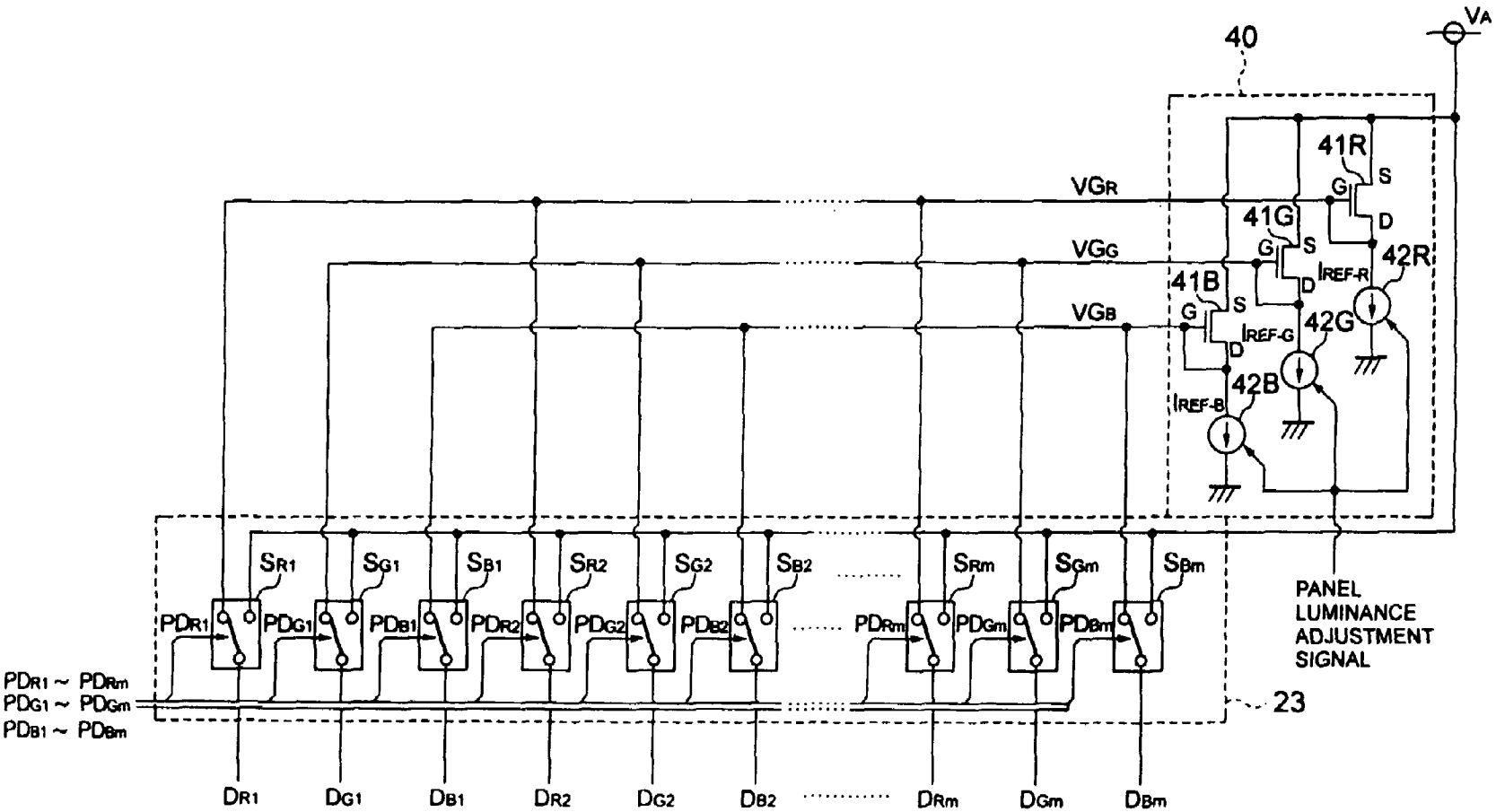
FIG. 4 is a diagram showing an internal construction of a reference gate voltage generating circuit 40 and a data driver 23.

FIG. 4 is a diagram showing the internal construction of the reference gate voltage generating circuit 40 and data driver 23.

The reference gate voltage generating circuit 40 is constituted by an FET 41R and a variable current source 42R for generating the reference gate voltage $VG_R$, an FET 41G and a variable current source 42G for generating the reference gate voltage $VG_G$, and an FET 41B and a variable current source 42B for generating the reference gate voltage $VG_B$.

Gate-source voltage/output current characteristics, drain-source voltage/output current characteristics, and other electrical characteristics of the FETs 41R, 41G, and 41B are almost the same as those of the FET 12 for the light emission drive. Preferably, the FETs 41R, 41G, and 41B are transistors manufactured by using almost the same material as that of the FET 12 so as to have almost the same size and structure as those of the FET 12. That is, the FETs 41R, 41G, and 41B are transistors manufactured by almost the same specification as, and more preferably, by the same process as those of the FET 12 for the light emission drive. Therefore, it can be expected that temperature-related fluctuation characteristics and time-related fluctuation characteristics of the FETs 41R, 41G, and 41B and those of the FET 12 are the same.

The power voltage $V_A$ supplied from the power source circuit (not shown) is applied to a source of each of the FETs 41R, 41G, and 41B. The variable current source 42R for supplying a reference current $I_{REF\text{-}R}$ is connected to a drain of the FET 41R. The drain and a gate of the FET 41R are mutually connected. A gate voltage, therefore, which is necessary when the reference current $I_{REF\text{-}R}$ flows between the source and drain of the FET 41R is developed at the gate of the FET 41R. The gate voltage is generated as a reference gate voltage $VG_R$. The variable current source 42G for supplying a reference current $I_{REF\text{-}G}$ is connected to a drain of the FET 41G. The drain and a gate of the FET 41G are mutually connected. A gate voltage, therefore, which is necessary when the reference current $I_{REF-G}$ flows between the source and drain of the FET 41G is developed at the gate of the FET 41G. The gate voltage is generated as a reference gate voltage $VG_G$. The variable current source 42B for supplying a reference current $I_{REF-B}$ is connected to a drain of the FET 41B. The drain and a gate of the FET 41B are mutually connected. A gate voltage, therefore, which is necessary when the reference current $I_{REF-B}$ flows between the source and drain of the FET 41B is developed at the gate of the FET 41B. The gate voltage is generated as a reference gate voltage $VG_B$.

Each of the variable current sources 42R, 42G, and 42B generates a reference current $I_{REF}$ corresponding to a panel luminance adjustment signal supplied from the drive control circuit 20 so as to adjust a luminance level of the whole display panel. In this case, the reference current $I_{REF}$ is the same as a light emission drive current to be supplied to the EL device 15 provided in the EL unit E as shown in FIG. 2. If the transistor size of each of the FETs 41R, 41G, and 41B is different from that of the FET 12, it is not always necessary that the reference current $I_{REF}$ is the same as the light emission drive current. The reference current $I_{REF}$ can also be supplied from the outside of the display panel.

The data driver 23 is constituted by switching devices $S_{R1}$ to $S_{Rm}$, switching devices $S_{G1}$ to $S_{Gm}$, and switching devices $S_{B1}$ to $S_{Bm}$.

The switching devices $S_{R1}$ to $S_{Rm}$ selectively apply either the power voltage $V_A$ supplied from the power source circuit or the reference gate voltage $VG_R$ supplied from the reference gate voltage generating circuit 40 to the red drive data lines $D_{R1}$ to $D_{Rm}$ of the display panel 10 in accordance with a logic level of each of the pixel data $PD_{R1}$ to $PD_{Rm}$ supplied in correspondence to those switching devices. For example, if the pixel data $PD_{R1}$ is at the logic level 1, the switching device $S_{R1}$ applies the reference gate voltage $VG_R$ to the red drive data line $D_{R1}$. If the pixel data $PD_{R1}$ is at the logic level 0, the switching device $S_{R1}$ applies the power voltage $V_A$ to the red drive data line $D_{R1}$. When the power voltage $V_A$ is selected, thus, the pixel data voltage $DP_R$ having the power voltage $V_A$ is applied to the red drive data line $D_R$. When the reference gate voltage $VG_R$ is selected, the pixel data voltage $DP_R$ having the reference gate voltage $VG_R$ is applied to the red drive data line $D_R$. The switching devices $S_{G1}$ to $S_{Gm}$ selectively apply either the power voltage $V_A$ supplied from the power source circuit or the reference gate voltage $VG_G$ supplied from the reference gate voltage generating circuit 40 to the green drive data lines $D_{G1}$ to $D_{Gm}$ of the display panel 10 in accordance with a logic level of each of the pixel data $PD_{G1}$ to $PD_{Gm}$ supplied in correspondence to those switching devices. For example, if the pixel data $PD_{G1}$ is at the logic level 1, the switching device $S_{G1}$ applies the reference gate voltage $VG_G$ to the green drive data line $D_{G1}$. If the pixel data $PD_{G1}$ is at the logic level 0, the switching device $S_{G1}$ applies the power voltage $V_A$ to the green drive data line $D_{G1}$. When the power voltage $V_A$ is selected, thus, the pixel data voltage $DP_G$ having the power voltage $V_A$ is applied to the green drive data line $D_G$. When the reference gate voltage $VG_G$ is selected, the pixel data voltage $DP_G$ having the reference gate voltage $VG_G$ is applied to the green drive data line $D_G$. The switching devices $S_{B1}$ to $S_{Bm}$ selectively apply either the power voltage $V_A$ supplied from the power source circuit or the reference gate voltage $VG_B$ supplied from the reference gate voltage generating circuit 40 to the blue drive data lines $D_{B1}$ to $D_{Bm}$ of the display panel 10 in accordance with a logic level of each of the pixel data $PD_{B1}$ to $PD_{Bm}$ supplied in correspondence to those switching devices. For example, if the pixel data $PD_{B1}$ is at the logic level 1, the switching device $S_{B1}$ applies the reference gate voltage $VG_B$ to the blue drive data line $D_{B1}$. If the pixel data $PD_{B1}$ is at the logic level 0, the switching device $S_{B1}$ applies the power voltage $V_A$ to the blue drive data line $D_{B1}$. When the power voltage $V_A$ is selected, thus, the pixel data voltage $DP_B$ having the power voltage $V_A$ is applied to the blue drive data line $D_B$. When the reference gate voltage $VG_B$ is selected, the pixel data voltage $DP_B$ having the reference gate voltage $VG_B$ is applied to the blue drive data line $D_B$. A voltage value of the power voltage $V_A$ which is supplied at the time of the logic level 0 is equal to a value by which the FET 12 can be turned off.

When the pixel data voltage DP having the reference gate voltage ($VG_R$, $VG_G$, $VG_B$) is supplied to the gate of the FET 12 in the EL unit E as shown in FIG. 2 via the data line D and the FET 11, the FET 12 supplies light emission drive currents ($Id_R$, $Id_G$, $Id_B$) to allow the EL device 15 to emit the light at a predetermined luminance to the EL device 15.

As mentioned above, the FETs 41R, 41G, and 41B are manufactured according to the same specification as that of the FET 12 for light emission driving. Therefore, the amount of the fluctuation of the gate-source voltage/output current characteristics of the FET 12 caused by the temperature-related change, change with the passage of time, or the like also appears in a fluctuation of the gate-source voltage/output current characteristics of each of the FETs 41R, 41G, and 41B. The reference currents ($I_{REF-R}$, $I_{REF-G}$, $I_{REF-B}$) are the same as the light emission drive currents ($Id_R$, $Id_G$, $Id_B$) to be supplied when the EL device 15 provided in the EL unit E as shown in FIG. 2 is allowed to emit the light at the predetermined luminance.

According to the construction described above, therefore, the reference gate voltages ($VG_R$, $VG_G$, $VG_B$) which can supply the light emission drive currents ($Id_R$, $Id_G$, $Id_B$) which are almost the same as the reference currents ($I_{REF-R}$, $I_{REF-G}$, $I_{REF-B}$) generated by the variable current sources (42R, 42G, 42B) to the EL device 15 are generated consistently. The EL device, consequently, can always emit light always at the predetermined luminance irrespective of the fluctuation of the gate-source voltage/output current characteristics of the FET 12 which is caused due to the temperature-related change, change with the passage of time, or the like.

When adjusting the luminance of the entire display panel, in accordance with the panel luminance adjustment signal, the variable current sources (42R, 42G, 42B) provided for the reference gate voltage generating circuit 40 change the reference currents ($I_{REF-R}$, $I_{REF-G}$, $I_{REF-B}$) to be generated. In this case, the luminance level of the entire display panel can be adjusted to the luminance level corresponding to the panel luminance adjustment signal irrespective of the fluctuation of the gate-source voltage/output current characteristics of the FET 12 due to the temperature-related change, change with the passage of time, or the like.

Figure 5:
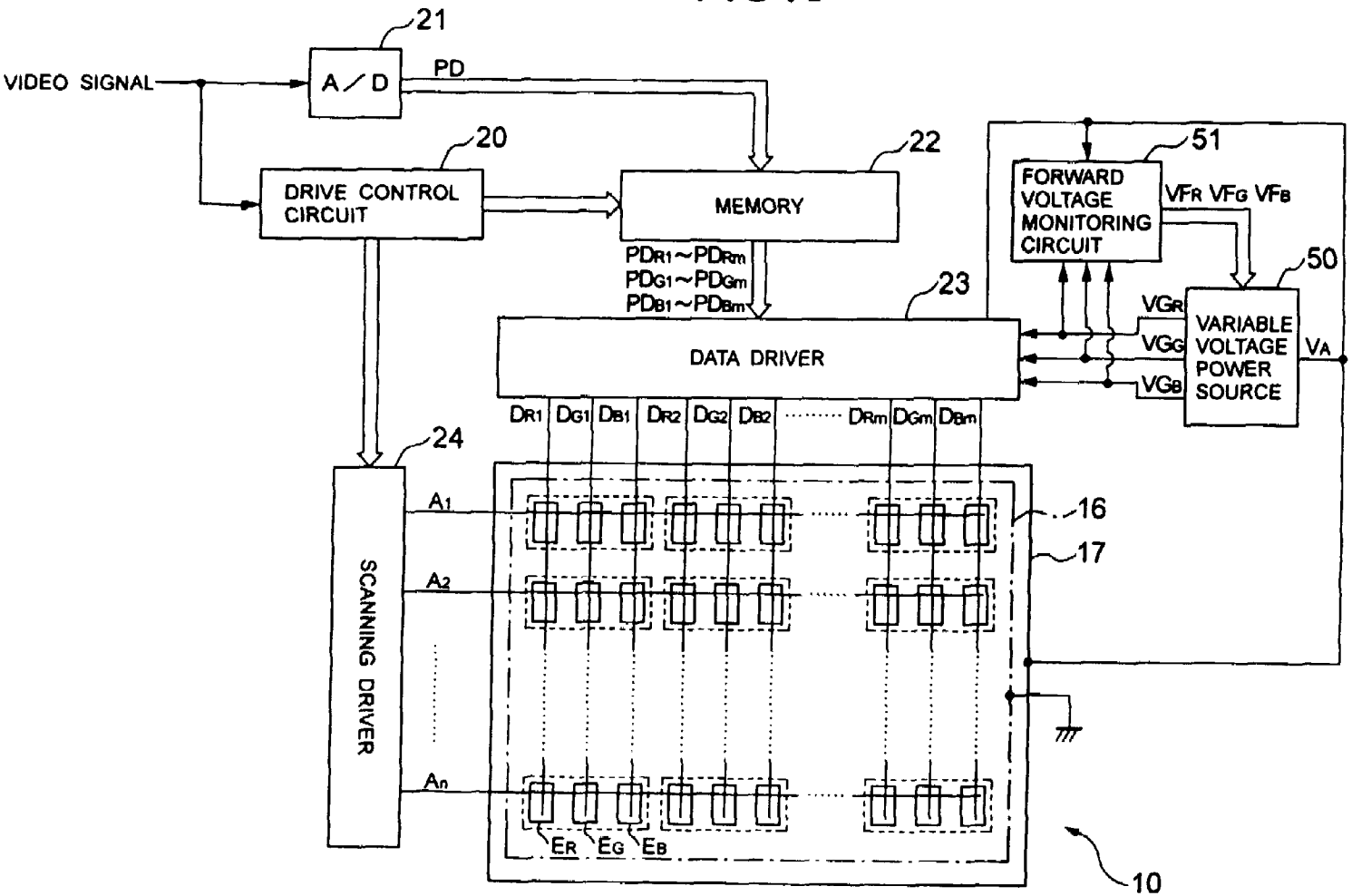
FIG. 5 is a diagram showing the construction of an EL display apparatus according to another embodiment of the invention.

FIG. 5 is a diagram showing the construction of an EL display apparatus of the active matrix driving type according to another embodiment of the invention.

In the EL display apparatus shown in FIG. 5, the construction is substantially the same as that shown in FIG. 3 except that a variable voltage power source 50 and a forward voltage monitoring circuit 51 are provided in place of the reference gate voltage generating circuit 40 and power source circuit (not shown) provided for the EL display apparatus shown in FIG. 3. The operations of the variable voltage power source 50 and forward voltage monitoring circuit 51 will, therefore, be described mainly herein below.

The operation of the variable voltage power source 50 generates the power voltage $V_A$ for light emission driving and supplies it to the common power electrode 17 of the display panel 10, the data driver 23, and the forward voltage monitoring circuit 51. The variable voltage power source 50 also generates the reference gate voltages ($VG_R$, $VG_G$, $VG_B$) and supplies the reference gate voltages to the data driver 23 and forward voltage monitoring circuit 51.

Figure 6:
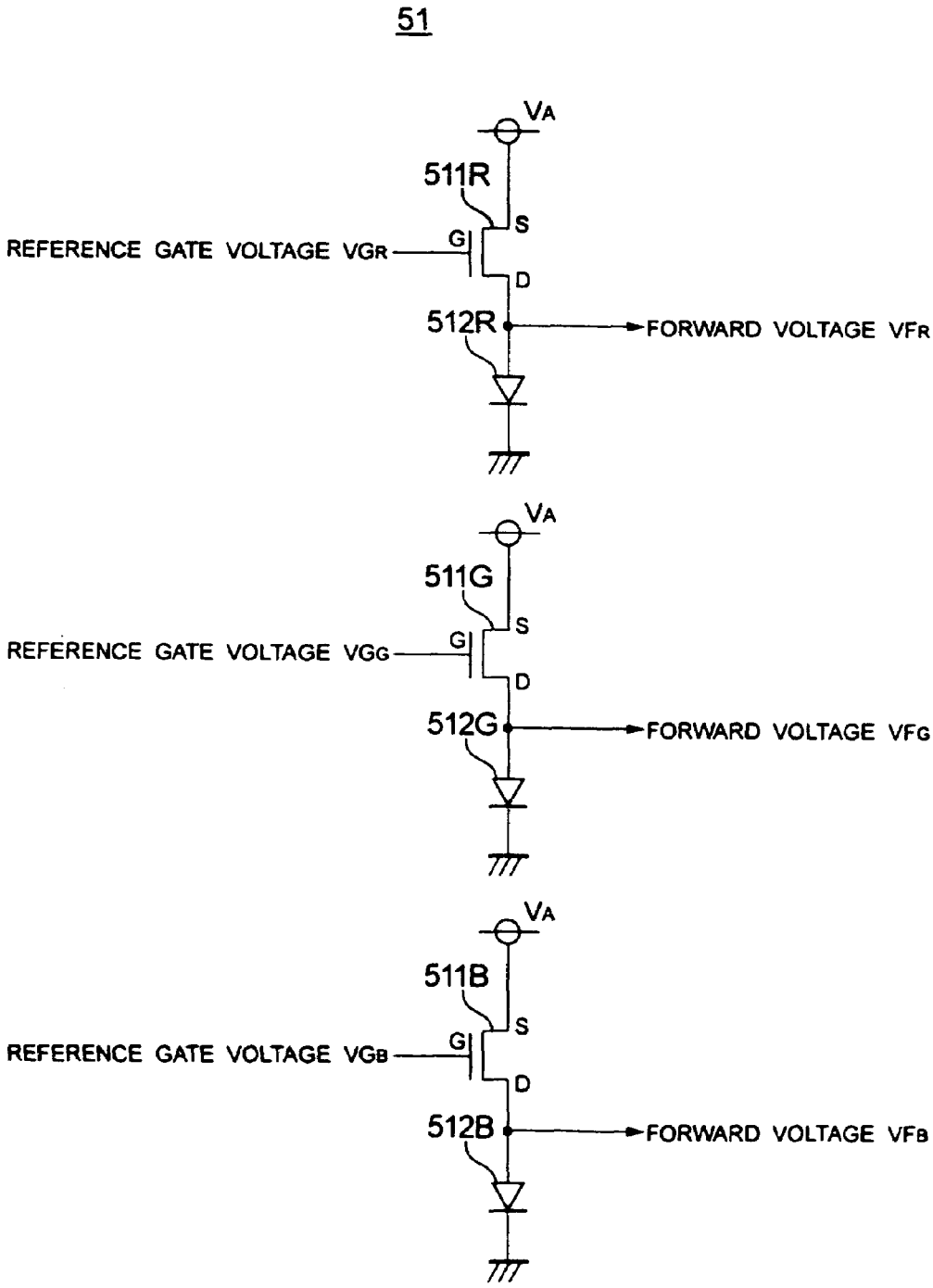
FIG. 6 is a diagram showing the internal construction of a forward voltage monitoring circuit 51 mounted in the EL display apparatus shown in FIG. 5.

FIG. 6 is a diagram showing an internal construction of the forward voltage monitoring circuit 51.

In FIG. 6, the power voltage $V_A$ supplied from the variable voltage power source 50 is applied to a source of a monitoring FET (Field Effect Transistor) 511R and the reference gate voltage $VG_R$ is supplied to the gate of the monitoring FET 511R. A monitoring EL device 512R is an EL device which emits light in red, its cathode is connected to the ground and the drain of the monitoring FET 511R is connected to an anode of the EL device 512R. A voltage developed at a connecting point of the anode of the EL device 512R, and the drain of the monitoring FET 511R is produced as a forward voltage $VF_R$ of the monitoring EL device 512R. The power voltage $V_A$ supplied from the variable voltage power source 50 is applied to the source of a monitoring FET (Field Effect Transistor) 511G and the reference gate voltage $VG_G$ is supplied to a gate of the monitoring FET 511G. An EL device 512G for monitoring is an EL device which emits light in green, its cathode is connected to the ground, and a drain of the monitoring FET 511G is connected to an anode of the EL device 512G. A voltage developed at a connecting point of the anode of the EL device 512G and the drain of the monitoring FET 511G is produced as a forward voltage $VF_G$ of the monitoring EL device 512G. The power voltage $V_A$ supplied from the variable voltage power source 50 is applied to a source of a monitoring FET (Field Effect Transistor) 511B and the reference gate voltage $VG_B$ is supplied to a gate of the monitoring FET 511B. A monitoring EL device 512B is an EL device which emits light in blue, its cathode is connected to the ground, and the drain of the monitoring FET 511B is connected to an anode of the monitoring EL device 512B. A voltage developed at a connecting point of the anode of the monitoring EL device 512B and the drain of the monitoring FET 511B is produced as a forward voltage $VF_B$ of the monitoring EL device 512B.

Gate-source voltage/output current characteristics, drain-source voltage/output current characteristics, and other electrical characteristics of the monitoring FETs 511R, 511G, and 511B are almost the same as that of the FET 12 for the light emission drive. More preferably, the FETs 511R, 511G, and 511B are transistors manufactured by using an almost the same material as that of the FET 12 so as to have almost the same size and structure as that of the FET 12. That is, the FETs 511R, 511G, and 511B are transistors manufactured according to almost the same specification as that of the FET 12 for the light emission drive. Therefore, it can be expected that temperature-related fluctuation characteristics and time-related fluctuation characteristics of the FETs for monitoring 511R, 511G, and 511B and the fluctuations of the FET 12 are the same.

Further, the forward voltages and other electrical characteristics of the monitoring EL devices 512R, 512G, and 512B are almost the same as that of the EL device 15. More preferably, the monitoring EL device 512R is an EL device manufactured by using almost the same material as that of the EL device 15 provided in the EL unit $E_R$ so as to have almost the same size and structure as that of the EL device 15. The monitoring EL device 512G is an EL device manufactured by using almost the same material as that of the EL device 15 provided in the EL unit $E_G$ so as to have almost the same size and structure as that of the EL device 15. The monitoring EL device 512B is an EL device manufactured by using almost the same material as that of the EL device 15 provided in the EL unit $E_B$ so as to have almost same size and structure as that of the EL device 15. That is, the monitoring EL devices 512R, 512G, and 512B are EL devices manufactured by almost the same specifications as those of the EL device 15 emitting the red light, the EL device 15 emitting the green light, and the EL device 15 emitting the blue light, respectively. Therefore, it can be expected that temperature fluctuating characteristics and aging fluctuating characteristics of the monitoring EL devices 512R, 512G, and 512B and the fluctuations of the EL device 15 are the same.

By the construction as mentioned above, the forward voltage monitoring circuit 51 provide the forward voltages of the EL device 15 which will be developed when the FET 12 for the light emission drive is driven by the reference gate voltages ($VG_R$, $VG_G$, and $VG_B$) as forward voltage $VF_R$, $VF_G$, and $VF_B$.

The variable voltage power source 50 changes the power voltage $V_A$ and/or the reference gate voltage $VG_R$ to be produced so that a differential value between the power voltage $V_A$ which is presently generated and the forward voltage $VF_R$ supplied from the forward voltage monitoring circuit 51 is equal to a predetermined voltage value. That is, the variable voltage power source 50 changes the power voltage $V_A$ and/or the reference gate voltage $VG_R$ in a manner such that the voltage between the drain and source of the FET 12 provided in the EL unit $E_R$ is equal to the voltage value by which the FET 12 can stably supply the predetermined light emission drive current Id. The variable voltage power source 50 changes the power voltage $V_A$ and/or the reference gate voltage $VG_G$ to be generated so that a differential value between the power voltage $V_A$ which is presently generated and the forward voltage $VF_G$ supplied from the forward voltage monitoring circuit 51 is equal to a predetermined voltage value. That is, the variable voltage power source 50 changes the power voltage $V_A$ and/or the reference gate voltage $VG_G$ in a manner such that the voltage between the drain and source of the FET 12 provided in the EL unit $E_G$ is equal to the voltage value by which the FET 12 can stably supply the predetermined light emission drive current Id. Further, the variable voltage power source 50 changes the power voltage $V_A$ and/or the reference gate voltage $VG_B$ to be generated so that a differential value between the power voltage $V_A$ which is presently generated and the forward voltage $VF_B$ supplied from the forward voltage monitoring circuit 51 is equal to a predetermined voltage value. That is, the variable voltage power source 50 changes the power voltage $V_A$ and/or the reference gate voltage $VG_B$ in a manner such that the voltage between the drain and source of the FET 12 provided in the EL unit $E_B$ is equal to the voltage value by which the FET 12 can stably supply the predetermined light emission drive current Id. If the proper power voltages $V_A$ are different in the red light emission driving, green light emission driving, and blue light emission driving, the differential values can be set to different voltage values or can be also set to the highest voltage value.

According to the construction mentioned above, the power voltage $V_A$ and/or the reference gate voltage VG which should be supplied to the FET 12 serving as a transistor for light emission driving is always automatically set to the voltage value by which the proper light emission drive current Id can be supplied to the EL device. Therefore, the loss of electric power is reduced as compared with the case where the slightly high power voltage $V_A$ is supplied in a fixed manner in consideration of the fluctuation in forward voltage of the EL device due to the temperature-related change, change with the passage of time, or the like.

Although the embodiment shown in FIG. 5 is arranged so that the reference gate voltage VG is also generated together with the power voltage $V_A$ by the variable voltage power source 50, it is also possible to adopt an arrangement that the reference gate voltage VG is generated by the reference gate voltage generating circuit 40 shown in FIG. 3.

Figure 7:
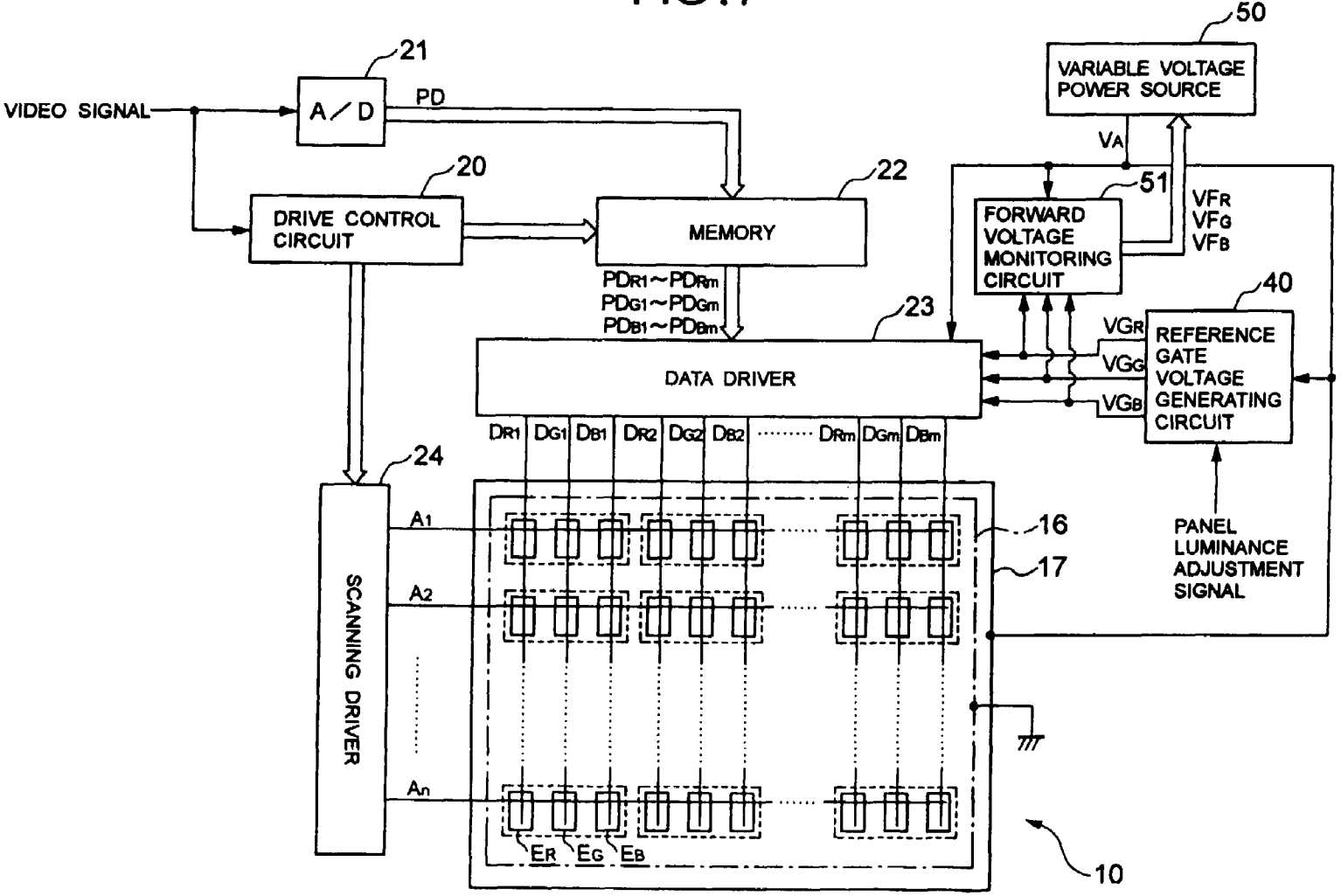
FIG. 7 is a diagram showing the construction of an EL display apparatus according to still another embodiment of the invention.

FIG. 7 is a diagram showing a construction of an EL display apparatus of the active matrix driving type according to another embodiment of the invention made in consideration of the problem mentioned above.

In the EL display apparatus shown in FIG. 7, the operations of the display panel 10, drive control circuit 20, A/D converter 21, memory 22, data driver 23, and scanning driver 24 are substantially the same as those shown in FIG. 3 or 5, and their description will not be repeated.

In FIG. 7, a variable voltage power source 50' generates the power voltage $V_A$ for light emission driving and supplies it to the common power electrode 17 of the display panel 10, the data driver 23, the forward voltage monitoring circuit 51, and the reference gate voltage generating circuit 40, respectively.

The reference gate voltage generating circuit 40 generates a gate voltage which is required when the FET 12 in the EL unit $E_R$ supplies the light emission drive current Id which is almost the same current as the reference current $I_{REF}$ to the EL device 15, and supplies it as a reference gate voltage $VG_R$ to the data driver 23 and forward voltage monitoring circuit 51. The reference gate voltage generating circuit 40 generates a gate voltage which is necessary when the FET 12 in the EL unit $E_G$ supplies the light emission drive current Id which is the same current as the reference current $I_{REF}$ to the EL device 15 and supplies it as a reference gate voltage $VG_G$ to the data driver 23 and forward voltage monitoring circuit 51. The reference gate voltage generating circuit 40 further generates a gate voltage which is necessary when the FET 12 in the EL unit $E_B$ supplies the light emission drive current Id which is the same current as the reference current $I_{REF}$ to the EL device 15 and supplies it as a reference gate voltage $VG_B$ to the data driver 23 and forward voltage monitoring circuit 51.

The reference gate voltage generating circuit 40 has the construction as shown in FIG. 4 and its internal operation is substantially the same as that mentioned above.

The forward voltage monitoring circuit 51 has the construction as shown in FIG. 6 and its internal operation is substantially the same as that mentioned above. That is, the forward voltage monitoring circuit 51 detects the forward voltages ($VF_R$, $VF_G$, and $VF_B$) of the EL device 15 which will be developed when the FET 12 for light emission driving is driven by the reference gate voltages ($VG_R$, $VG_G$, $VG_B$) supplied from the reference gate voltage generating circuit 40. The forward voltage monitoring circuit 51 supplies those forward voltages ($VF_R$, $VF_G$, $VF_B$) to the variable voltage power source 50'.

The variable voltage power source 50' changes the power voltage $V_A$ to be generated in a manner such that all of the differential values between the power voltage $V_A$ which is at present being generated and the forward voltages ($VF_R$, $VF_G$, $VF_B$) supplied from the forward voltage monitoring circuit 51 lie within a predetermined voltage value range. That is, the variable voltage power source 50' changes the power voltage $V_A$ in a manner such that the drain-source voltage of the FET 12 provided in the EL unit E is equal to the voltage value by which the FET 12 can stably supply the predetermined light emission drive current Id.

According to the construction mentioned above, the power voltage $V_A$ to be supplied to the FET 12 for light emission driving is always automatically set to the voltage value by which the proper light emission drive current Id can be supplied to the EL device. Inefficient electric power consumption is, therefore, reduced more than that in the case where a slightly higher power voltage $V_A$ is fixedly supplied in consideration of the fluctuation in forward voltage of the EL device due to the temperature-related change, change with the passage of time, or the like. Further, the reference gate voltages ($VG_R$, $VG_G$, $VG_B$) by which the light emission drive current Id of almost the same current as the reference current generated by the current source can be supplied to the EL device 15 are generated. The EL device, consequently, is allowed to emit light always at the predetermined luminance irrespective of the fluctuation of the gate-source voltage/output current characteristics of the FET 12 which is caused due to the temperature-related change, change with the passage of time, or the like.

According to the display apparatus of the invention as described above, even if the characteristics of the transistors for light emission driving and the EL device fluctuate due to an influence of temperature-related change, change with the passage of time, or the like, the EL device can be allowed to always emit light at the predetermined luminance while suppressing the electric power consumption.

This application is based on Japanese patent application No. 2001-360715 which is hereby incorporated by reference.

What is claimed is:

1. A display apparatus having a display panel in which light emitting units are arranged in a matrix each said light emitting units being constituted by a driving transistor for generating a drive current in accordance with a voltage applied to a control terminal thereof and a light emitting device for emitting light in accordance with said drive current, comprising:

a reference control voltage generating circuit which includes a series circuit connected between ground and a power voltage, said series circuit being constituted by a current source for generating a reference current and a reference transistor having an input terminal for said power voltage, an output terminal to which said current source is connected, and a control terminal connected to said output terminal and having electrical characteristics substantially identical to said driving transistor and which produces a voltage on said control terminal of said reference transistor as a reference control voltage; and a data driver for supplying one of said power voltage and said reference control voltage to said control terminal of said driving transistor in accordance with pixel data of each pixel based on an input video signal, wherein said power voltage or said reference control voltage produced by said reference control voltage generating circuit is selectively supplied to data lines of said matrix of said light emitting units through said data driver.

2. An apparatus according to claim 1, wherein said reference transistor has a substantially identical specification as said driving transistor.

3. An apparatus according to claim 1, wherein said current source generates a current corresponding to a panel luminance adjustment signal for adjusting a luminance level of said whole display panel, as said reference current.

4. An apparatus according to claim 1, wherein said light emitting device is an electroluminescence device.

5. An apparatus according to claim 1, wherein said current source of said reference control voltage generating circuit is a variable current source which generates said reference current according to a panel luminance adjusting signal.

* * * * *